US005370289A

United States Patent [19]

Helms

[11] Patent Number: 5,370,289

[45] Date of Patent: Dec. 6, 1994

[54] AIRFOIL FLOATER APPARATUS FOR A RUNNING WEB

[75] Inventor: Randall D. Helms, Green Bay, Wis.

[73] Assignee: Advance Systems, Inc., Green Bay, Wis.

[21] Appl. No.: 838,966

[22] Filed: Feb. 21, 1992

[51] Int. Cl.[5] ..... B65H 20/14

[52] U.S. Cl. ..... 226/97; 34/640; 34/654

[58] Field of Search ..... 226/7, 97; 34/156, 160

[56] References Cited

U.S. PATENT DOCUMENTS

| | | | |
|---|---|---|---|
| 3,060,594 | 10/1962 | Meier-Windhorst | 34/160 X |
| 3,705,676 | 12/1972 | Overly et al. | 226/97 |
| 4,069,595 | 1/1978 | Ahlbert et al. | 226/99 X |
| 4,074,841 | 2/1978 | Kramer et al. | 226/97 |
| 4,085,522 | 4/1978 | Stroszynski | 226/7 X |
| 4,308,984 | 1/1982 | Vits | 226/7 X |
| 4,472,888 | 9/1984 | Spiller | 226/97 X |
| 4,698,914 | 10/1987 | Shu et al. | 34/10 |
| 4,787,547 | 11/1988 | Hella et al. | 226/97 |

FOREIGN PATENT DOCUMENTS

| | | | |
|---|---|---|---|
| 8808950 | 11/1988 | WIPO | 226/97 |

*Primary Examiner*—Daniel P. Stodola
*Attorney, Agent, or Firm*—Nilles & Nilles

[57] ABSTRACT

Apparatus including a single sided airfoil floater conveyor for floatingly conveying a running web of indeterminate length. The apparatus has a series of longitudinal air bars arranged in parallelism and spaced along the path of web movement. The bars have a rear edge and a perforated foil extends along and from the bar rear edge and terminates in a trailing edge. A tail plate extends along the foil trailing edge and away therefrom in a direction of web movement, and forms an air outlet opening with the next adjacent air bar for the exit of spent air. The tail plates act to maintain velocity of the air passing thereover and thereby results in a decrease of air pressure on the web and consequently tends to pull the web down. This inhibits the web from excessive floating and prevents uncontrolled instability and excessive fluttering of the web.

17 Claims, 4 Drawing Sheets

AIRFOIL FLOATER APPARATUS FOR A RUNNING WEB

BACKGROUND OF THE INVENTION

1. Field of the Invention

The present invention pertains to apparatus for advancing material of indeterminate length. More specifically, the invention relates to a single sided flotation conveyor for a running web that has been coated on one side. The conveyor uses air bars and fluid current such as air for conveying the web material.

2. Background Information

The present invention relates to a single sided flotation system for floatingly suspended running webs that have been coated only on one side. That coated side cannot be disturbed by air from, for example, a high velocity air dryer. The present invention is an improvement over the single sided web flotation systems of the prior art., in some of which unstable flotation has been a severe problem over the years. An example of a prior art single sided floater is shown in U.S. Pat. No. 4,698,914, issued Oct. 13, 1987 to Ming-tsai Shu et al.

SUMMARY OF THE INVENTION

The present invention provides a single sided airfoil conveyor for floatingly conveying a running web which has been coated on one side and wherein the particular coating cannot be disturbed by an air flow such as in high velocity dryers. The conveyor comprises a series of longitudinal air bars arranged in parallelism and spaced along the path of the web movement. These bars are of the single slot type and have a leading edge with an air nozzle slot therealong for directing pressurized air from within the air bar against the uncoated side of the web. These air bars have a pressure cushion surface over which the pressurized air is directed to form a pressure cushion for floatingly supporting the web. At the rear edge of the air bar is a perforated foil which extends therealong and is inclined at an angle away from the web and in a direction of web movement. A flat tail plate is located along the trailing edge of the perforated foil and extends in a direction of web movement away from the foil. The tail plate acts to prevent premature escape of the air and thus maintains the velocity of the air and prevents air pressure buildup, according to the Bernoulli theorem. Thus the web does not rise or float excessively, but instead is held down. The air then exits through the air outlet opening which is defined by the end of the tail plate and the next succeeding, adjacent air bar.

A more limited aspect of the invention relates to the adjustability of the flat tail plate as to its angle with respect to the web whereby the velocity of the web and consequently the air pressure on it can be varied to adjust the amount of float of the web and thereby stabilize the web. Another aspect of the invention relates to an airfoil conveyor of the above type which is located in an enclosed housing through which the web passes.

The invention also contemplates an airfoil floater having a single slot air bar, a perforated foil extending at an angle from the rear edge of said bar, and an angularly adjustable tail plate extending along the trailing edge of the foil.

These and other objects and advantages of the present invention will appear hereinafter as this disclosure progresses.

DESCRIPTION OF THE PREFERRED EMBODIMENT

Figure 1:
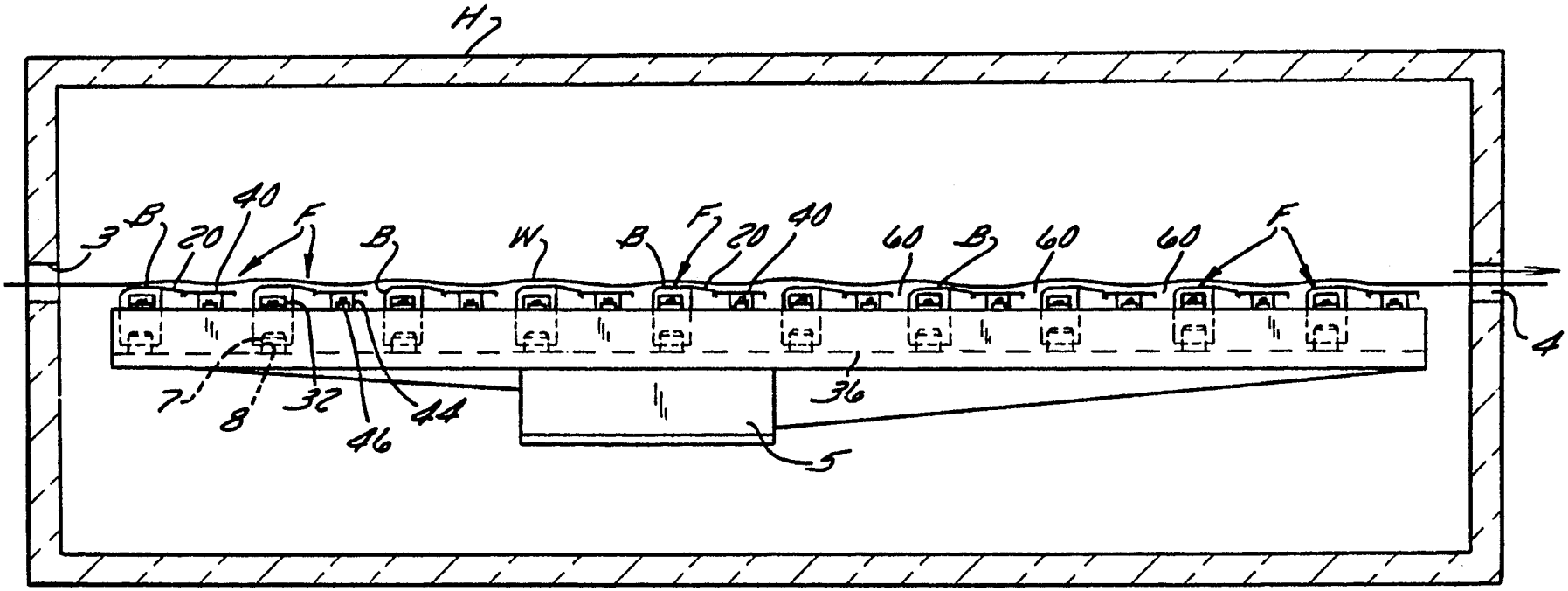
FIG. 1 is a more or less schematic, vertical cross-sectional view through a housing and showing a plurality of air bars, perforated foils and flat tail plates embodying the present invention, and furthermore showing the position of the web as it moves through the conveyor.
Figure 5:
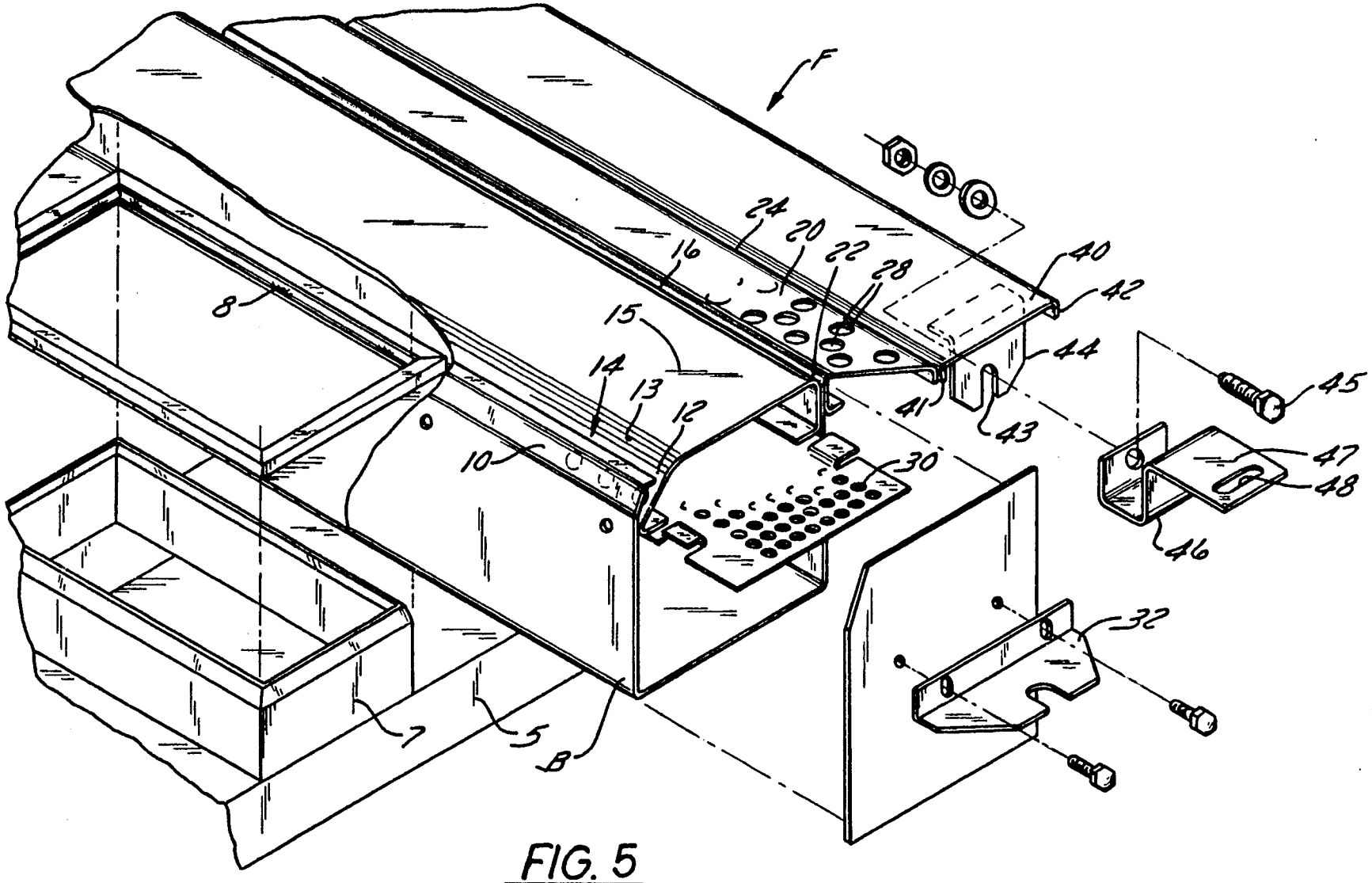
FIG. 5 is a fragmentary, enlarged, exploded, perspective view showing a portion of the air bar and the perforated foil.

The airfoil floater conveyor of the present invention has been shown in FIG. 1 as consisting of ten airfoil floaters F, although any number may be used depending on the length of the conveyor. The floaters include single slot air bars B which are arranged in parallelism to one another and spaced along the path of travel of the web W. The airfoil floater conveyor is shown as mounted within an insulating housing H and which has an entry slot 3 at one end and an exit slot 4 for the web at the other. The air bars B, to be referred to in detail later, are hollow and are fed with pressurized air from a common duct 5 which in turn receives pressurized air from a source, not shown, but in the conventional manner. The air bars are in air receiving communication with the duct 5 by means of a neck 7 which extends from the duct 5 and over which the air bars are inserted by means of their rectangular openings 8 (FIG. 5). This construction is generally shown in U.S. Pat. No. 4,787,547, issued Nov. 29, 1988, and which has been assigned to an assignee common with the present invention. Thus, an elongated enclosed housing having an inlet slot and an outlet slot through which the web passes is provided and in which treatment of the coated web may occur, such as heating of the coated surface as it passes through the housing. Generally, the invention is a single-sided floater located on the uncoated side of the web, and in which the coated side of the web is sensitive to air blast and cannot be treated, for example, with high velocity air bars for drying.

As the web moves through the housing H, it is desirable to control the amount of float of the web above its air bars, that is, the present invention prevents excessive float and fluttering of the web and uncontrolled instability of the web. Heretofore as the web passed through air floater apparatus, it was subjected to a buildup or accumulation of pressure as it moved successively over the air bars so that by the time it reached the exit end of the conveyor, it was unstable and subject to excessive vibration and fluttering and excessive floating above the conveyor.

Referring in more detail to the air bar portion of the conveyor, it consists of an elongated hollow body fabricated from sheet steel, for example. The air bar has a leading edge 10 including an air nozzle slot 12 along the leading edge which is located adjacent a curved surface 13 of the air bar to form a well known Coanda nozzle 14. Thus air flows out from the interior of the bar, over the Coanda nozzle 14 and over the pressure cushion surface 15 of the air bar in a known manner. The surface 15 is inclined upwardly from the nozzle at an angle of about one degree, when referenced to the theoretical web line of zero degrees. The resulting air pressure cushion floatingly supports the web moving over it. The air bars also have a rear edge 16, in this case shown as a rather sharp corner, and an elongated perforated foil 20 extends along and from the bar rear edge 16 at a juncture 22. The foil 20 terminates in a trailing edge 24. The perforated airfoil 20 is rigidly secured to the rear side of the air bar by bolt means or the like so as to prevent any rattle or looseness therebetween. The trailing edge of the airfoil 24 includes a downwardly turned flange 26. It will be noted that the foil 20 is inclined at an angle downwardly in a direction of web movement and a preferred angle for this inclination from the horizontal is in the range of 0° to 10°. The airfoil has a series of perforations 28 along its length. The reason for perforations in the foil is to bleed or permit additional air to come upwardly from below the foil, thereby stabilizing the web. In other words, it is this additional volume of air that helps minimize the pressure differential at the so-called break point, that is, juncture 22 between the rear edge of the air bar and the front edge of the foil. At this juncture there is a pressure differential between these two surfaces and the perforations act to minimize the pressure differential at this area.

The air bar also includes an interior perforated sheet 30 which causes the air to be evenly distributed within the air bar and without appreciable cross currents as taught in U.S. Pat. No. 4,787,547. The air bar also includes the previously referred to rectangular opening 8 by means of which it is sealed over the air delivering necks 7 that extend from the common supply ducts 5.

Mounting brackets 32 are rigidly secured to the ends of the air bar by means of which they are secured to the two C-shaped frame members 36 extending within the housing, one of which extends along the length of each side of the housing. These channel shaped steel members 36 form part of the rigid framework of the housing and support the air bars, their airfoils 22 and their adjustable tail plate 40, now to be described.

Figure 3:
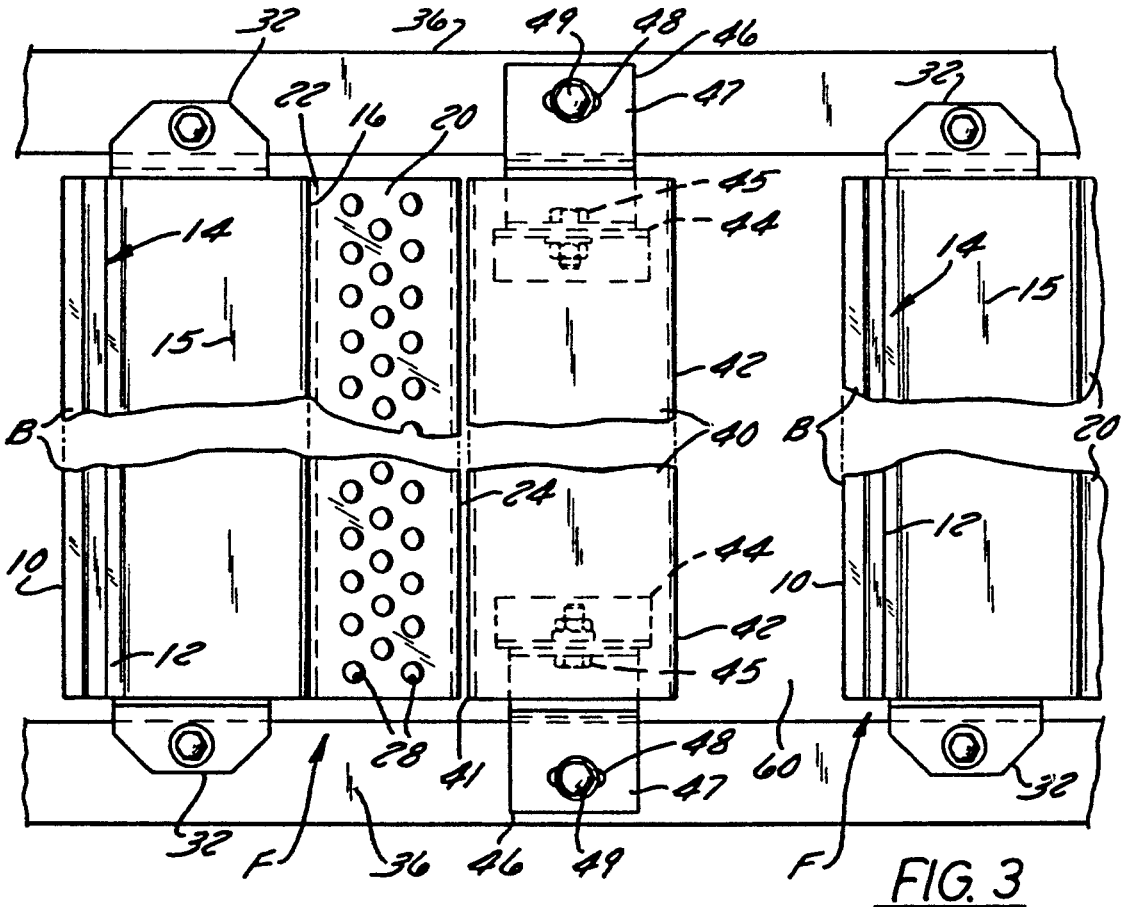
FIG. 3 is a plan view of the arrangement shown in FIG. 2.
Figure 4:
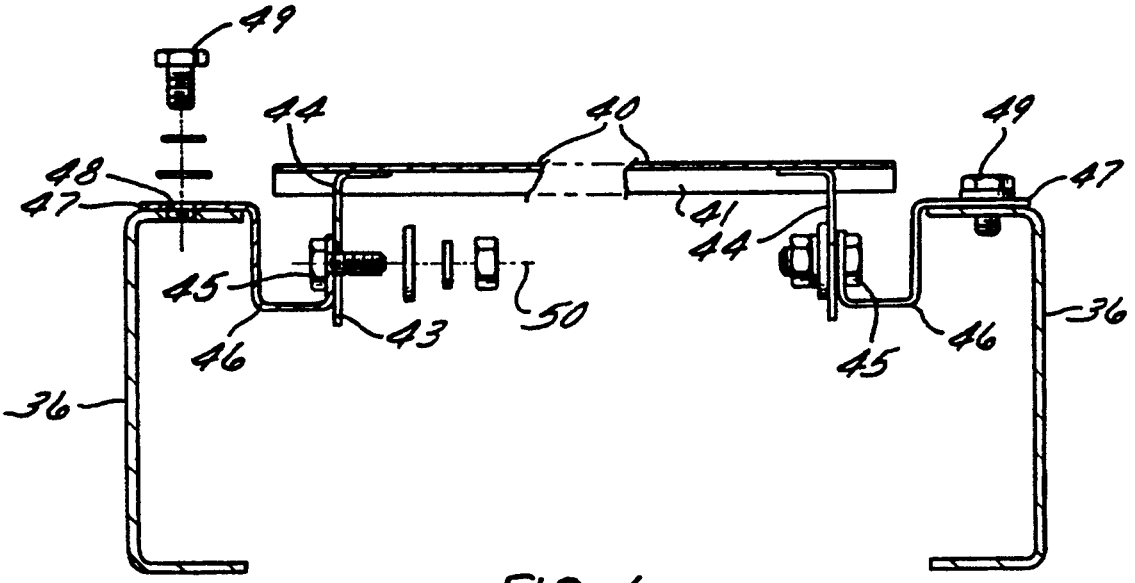
FIG. 4 is a sectional view taken generally along the line 4—4 in FIG. 2.

The tail plate 40, which is preferably flat as shown, is located closely adjacent the foil trailing edge flange 24. The tail plates are fabricated from sheet steel and have a forward downwardly depending flange 41 along its leading edge which lies closely adjacent flange 24 of the foil 22. Plate 40 also has a downwardly extending flange 42 along its rear edge, thus forming a rigid tail plate which is not subject to vibration, twisting or bending. The tail plates 40 are positioned closely adjacent the rear rigid trailing edge 24 of the foil and may be positioned in a horizontal manner (parallel to the theoretical web line) or at an angular relationship with respect to the web. The tail plate angular and elevational adjustment is made possible by the slots 43 in the brackets 44, which brackets are fixed to and depend downwardly from the tail plate, one being located adjacent each end of the plate. These brackets 44 are in turn secured by bolt means 45 to a bracket member 46 which is adjustably secured, by bolt means 49, by its top flange 47 to the C-shaped member 36 {FIG. 4). As shown in FIG. 3, the upper flange 47 of bracket 46 is slotted as at 48 so that bolt means 49 can be loosened to permit the flat plate to be adjustably positioned fore and aft relative to the foil 24. The flat tail plate 40 may be angularly adjusted about its longitudinal axis 50 (FIG. 4), that is, about the bolt means 45, by means of which the plate 40 is adjustably secured to the bracket 46.

It should be noted that the tail plates 40 may be individually adjustable as to their angle and all of the plates 40 need not be adjusted to the same angle. While they are individually adjustable relative to one another depending on the characteristics of the floater and the conditions under which it is operating, they are nevertheless usually adjusted within a narrow band of degree variation.

Figure 2:
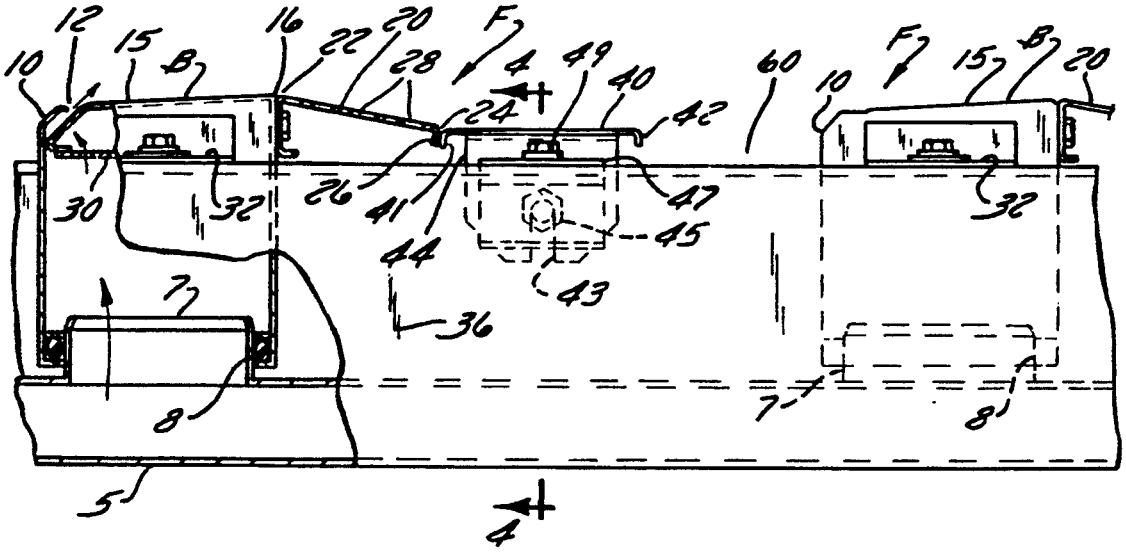
FIG. 2 is an enlarged, fragmentary portion of the showing of FIG. 1, the view being partially in section.

As previously mentioned, the number of air bars provided within the housing depends on the length of web to be supported during its pass through the housing. In respect to the spacing between the air bar floaters, generally the air bars are preferably spaced from one another on fifteen-inch to twenty-inch centers. The tail plates 40 are generally about two inches to seven inches wide in the direction of web travel and it has been found that the air exit slot 60 (FIGS. 1, 2 and 3) for spent air is about three inches when measured along the direction of web travel. The exit slot 60 is preferably held to a constant gap of three inches by varying the width of the tail plate. With this arrangement, good stability of the web can be provided throughout its length of travel through the housing and with minimum vibration, flutter or uncontrolled movement.

The single slot air bar B, its attached perforated foil 20 and the adjustable flat tail plate 40 are all rigidly secured to the channel shaped frame member 36 and together form a rigid airfoil floater.

In operation, as the web passes over the air bar, it is supported or floated by the pressure cushion pad formed on top of the air bar. As the air leaves the rear side of the air bar, its velocity can be controlled and, consequently, the pressure on the web can also be correspondingly controlled according to the Bernoulli theorem, to thereby adjust the amount of float provided. In other words, as the velocity of the air decreases, the pressure acting to float the web increases and vice versa. Thus the angular position of the airfoil and the flat tail plate can be adjusted to vary the amount of floating pressure on the web and consequently its vertical position.

The flat tail plate 40 can be adjusted from a horizontal position in which it is generally parallel to the theoretical web line, to a position 10° of incline downwarldy from the airfoil. For example, by tilting the flat tail plate downwardly at an angle of 10°, the velocity of the air passing thereover is decreased and the pressure acting on the web is correspondingly increased. Conversely, when the tail plate is horizontal, air velocity is maintained and air flotation pressure is decreased, holding the web down.

Generally, the tendency of the web, when it passes through an air conveyor without the use of flat tail plates as above described, will progressively rise as it passes through the housing and reaches a maximum height away from the air bars at the exit end of the housing. This is due to the accumulation of pressure against the underside of the web as it successively passes the plurality of air bars. The result is an uncontrolled fluttering of the web in many instances, and vibration and instability of the web.

The present invention provides an airfoil floater conveyor by means of which the running characteristics of the web can be accurately controlled.

What is claimed is:

1. An airfoil floater apparatus for floatingly supporting a running web, said apparatus including, an elongated, enclosed housing having a web inlet slot at one end and a web exit slot at its other end, a series of longitudinal air bars secured within said housing and arranged in parallelism and spaced along the path of web movement, means for supplying air pressure to the interior of said bars, said bars having a leading edge and an air nozzle slot along their leading edge for receiving pressurized air from the interior of said bars, said bars also having a pressure cushion surface for floatingly supporting a web moving thereover, said nozzle slot discharging air along said cushion surface to support said web, said bars also having a rear edge, a perforated foil extending along and from said bar rear edge and terminating in a trailing edge, said foil being inclined at an angle downwardly in a direction of web movement, and a flat tail plate secured within said housing and having a longitudinal axis and extending transversely along and closely adjacent said foil trailing edge and away therefrom in a direction of web movement, and forming an air outlet opening with the next adjacent air bar for the exit of spent air, whereby said tail plates act to vary velocity of the air passing thereover and vary the air pressure on the web and consequently inhibit the web from uncontrolled instability and excessive fluttering and excessive floating over said conveyor as the web moves through said housing.

2. The apparatus set forth in claim 1 further characterized in that said housing has an internal rigid frame including an internal steel member along each side thereof, said air bars and said tail plates being rigidly secured at their opposite ends to said steel members.

3. The apparatus described in claim 2 further including means for adjusting the angle of said tail plates about their longitudinal axis and relative to said web to thereby vary the air pressure on said web to control the amount of web float.

4. The apparatus described in claim 1 further including means for adjusting the angle of said tail plates about their longitudinal axis and relative to said web to thereby vary the air pressure on said web to control the amount of web float.

5. The conveyor set forth in claim 1 further characterized in that the angle of inclination of said foil is about eight degrees from the web.

6. The floater set forth in claim 1 further characterized in that said air bars are generally spaced from one another on about fifteen-inch to twenty-inch centers, the tail plates are generally about two inches to seven inches wide in a direction of web travel, and said air exit for spent air is about three inches.

7. A single sided airfoil floater conveyor for floatingly conveying a running web of indeterminate length and comprising a series of longitudinal air bars arranged in parallelism and spaced along the path of web movement, means for supplying air pressure to the interior of said bars, said bars having a leading edge and an air nozzle slot along their leading edge for receiving pressurized air from the interior of said bars, said bars also having a pressure cushion surface for floatingly supporting a web moving thereover, said nozzle slot discharging air along said cushion surface to support said web, said bars also having a rear edge, a perforated foil extending along and from said bar rear edge and terminating in a trailing edge, said foil being inclined at an angle downwardly in a direction of web movement, and a flat tail plate extending along and closely adjacent said foil trailing edge and away therefrom in a direction of web movement, and forming an air outlet opening with the next adjacent air bar for the exit of spent air, whereby said tail plates act to vary velocity of the air passing thereover and vary the air pressure on the web and consequently inhibit the web from uncontrolled instability and excessive fluttering and excessive floating over said conveyor.

8. The airfoil conveyor set forth in claim 7 further characterized in that said flat tail plates have a longitudinal axis extending across the path of the web, said tail plates being angularly adjustable about their longitudinal axis so as to change their angle with respect to the web to thereby vary the amount of float provided for the web as it moves over said flat tail plates.

9. The floater conveyor defined in claim 8 wherein said flat tail plate can be angularly adjusted from a horizontal position to a position in which it is inclined downwardly from said trailing edge at an angle of about 10 degrees.

10. The floater conveyor set forth in claim 7 wherein said bar leading edge and slot form a Coanda nozzle for causing said pressurized air to flow over said pressure cushion surface.

11. The conveyor described in claim 7 further characterized in that said means for supplying air pressure include a supply duct having an air delivering communication with each of said bars.

12. The conveyor set forth in claim 7 further characterized in that the angle of inclination of said foil is about eight degrees from the web.

13. The floater set forth in claim 7 further characterized in that said air bars are generally spaced from one another on about fifteen-inch to twenty-inch centers, the tail plates are generally about two inches to seven inches wide in a direction of web travel, and said air exit for spent air is about three inches.

14. An airfoil floater for floating a running web of indeterminate length and comprising an air bar having a leading edge and an air nozzle slot along said leading edge for receiving pressurized air from the interior of said bar, said bar also having a pressure cushion surface for floatingly supporting a web moving thereover, said nozzle slot adapted to discharge air along said cushion surface to support said web, said bar also having a rear edge, a perforated foil extending along and from said bar rear edge and terminating in a trailing edge, said foil being inclined at an angle downwardly away from said bar, and a flat tail plate extending along and closely adjacent said foil trailing edge and away therefrom in a general direction of web travel to prevent a progressive rise in the web due to an accumulation of pressure against the underside of the web as the web passes over said floater.

15. The airfoil floater set forth in claim 14 further characterized in that said flat tail plate has a longitudinal axis adapted to extend across the path of the web, said tail plate being angularly adjustable about its longitudinal axis so as to change its angle with respect to the web to thereby vary the amount of float provided for the web as it moves over said flat tail plate.

16. The floater defined in claim 15 wherein said flat tail plate can be angularly adjusted from a horizontal position to a position in which it is inclined downwardly from said trailing edge at an angle of about 10 degrees.

17. The floater conveyor set forth in claim 14 wherein said bar leading edge and slot form a Coanda nozzle for causing said pressurized air to flow over said pressure cushion surface.

* * * * *